US012601029B2

(12) United States Patent
Joyce et al.

(10) Patent No.: US 12,601,029 B2
(45) Date of Patent: Apr. 14, 2026

(54) IRON CONTAINING PELLETS

(71) Applicant: Binding Solutions Ltd, Middlesbrough (GB)

(72) Inventors: Richard Joyce, Middlesbrough (GB); Tamsyn Kingsley-Adams, Middlesbrough (GB)

(73) Assignee: Binding Solutions Ltd, Middlesbrough (GB)

( * ) Notice: Subject to any disclaimer, the term of this patent is extended or adjusted under 35 U.S.C. 154(b) by 0 days.

(21) Appl. No.: 19/187,831

(22) Filed: Apr. 23, 2025

(65) Prior Publication Data

US 2025/0297336 A1 Sep. 25, 2025

Related U.S. Application Data

(63) Continuation of application No. 18/551,584, filed as application No. PCT/GB2022/050691 on Mar. 18, 2022.

(30) Foreign Application Priority Data

Mar. 22, 2021 (GB) ..... 2103972

(51) Int. Cl.

| | |
|---|---|
| ***C22B 1/24*** | (2006.01) |
| ***C21C 5/52*** | (2006.01) |
| ***C22B 1/243*** | (2006.01) |
| ***C22B 1/244*** | (2006.01) |

(52) U.S. Cl.

CPC ..... *C22B 1/2406* (2013.01); *C21C 5/52* (2013.01); *C22B 1/243* (2013.01); *C22B 1/244* (2013.01)

(58) Field of Classification Search

CPC ..... C22B 1/2406; C22B 1/243; C22B 1/244; C22B 1/245; C22B 7/02; C21C 5/52; C21C 5/527; Y02P 10/20; C21B 13/0066

See application file for complete search history.

(56) References Cited

U.S. PATENT DOCUMENTS

| | | | | |
|---|---|---|---|---|
| 4,684,549 | A | 8/1987 | Allen et al. | |
| 5,000,783 | A | 3/1991 | Dingeman et al. | |
| 5,306,327 | A | 4/1994 | Dingeman et al. | |
| 5,782,957 | A | 7/1998 | Rinker et al. | |
| 6,071,325 | A | 6/2000 | Schmitt | |
| 6,149,709 | A | 11/2000 | Uragami et al. | |
| 6,342,089 | B1 * | 1/2002 | McGaa | C22B 1/243 75/319 |
| 6,384,126 | B1 | 5/2002 | Pirtle et al. | |
| 10,683,562 | B2 | 6/2020 | Hosono et al. | |
| 11,932,917 | B2 | 3/2024 | Pickett | |
| 2001/0047699 | A1 * | 12/2001 | Hoffman | C22B 1/24 75/765 |
| 2004/0107800 | A1 | 6/2004 | Nayak et al. | |
| 2006/0032327 | A1 | 2/2006 | Huege et al. | |
| 2012/0210824 | A1 | 8/2012 | Lehtinen et al. | |
| 2014/0033872 | A1 | 2/2014 | Martikainen et al. | |
| 2015/0344799 | A1 | 12/2015 | Vayda | |
| 2016/0244859 | A1 | 8/2016 | Beaudoin et al. | |
| 2017/0073781 | A1 | 3/2017 | O et al. | |
| 2018/0209012 | A1 | 7/2018 | Hosono et al. | |
| 2021/0108284 | A1 | 4/2021 | Pickett | |
| 2024/0093328 | A1 | 3/2024 | Joyce et al. | |

FOREIGN PATENT DOCUMENTS

| | | | |
|---|---|---|---|
| CA | 2869942 | A1 | 10/2013 |
| CN | 1041328 | C | 12/1998 |
| CN | 100348746 | C | 11/2007 |
| CN | 102127640 | A | 7/2011 |
| CN | 102296138 | A | 12/2011 |
| CN | 105886755 | A | 8/2016 |
| EP | 0225171 | A2 | 6/1987 |
| EP | 1367141 | A1 | 12/2003 |
| EP | 1439237 | A1 | 7/2004 |
| EP | 3124628 | A1 | 2/2017 |
| FR | 2098798 | A5 | 3/1972 |
| GB | 1364150 | A | 8/1974 |
| JP | S52115601 | U | 9/1977 |
| JP | 62158812 | A | 7/1987 |
| JP | S62149825 | A | 7/1987 |
| JP | S62149825 | U | 9/1987 |
| JP | H02270921 | A | 11/1990 |
| JP | H647237 | A | 2/1994 |
| JP | H09310112 | A | 12/1997 |
| JP | 2002322514 | A | 11/2002 |
| JP | 2003247026 | A | 9/2003 |
| JP | 2013543052 | A | 11/2013 |
| JP | 2015218351 | A | 12/2015 |

(Continued)

OTHER PUBLICATIONS

Nagarkar, Rigved, and Jatin Patel. "Polyvinyl alcohol: a comprehensive study." Acta Sci. Pharm. Sci 3.4 (2019): 34-44. (Year: 2019).*

International Search Report and Written Opinion for International Application No. PCT/GB2022/050691, Search completed Jun. 21, 2022, Mailed Jun. 30, 2022, 16 Pgs.

International Preliminary Report on Patentability for International Application No. PCT/GB2018/051010, Report issued Oct. 22, 2019, Mailed Oct. 31, 2019, 7 pgs.

International Search Report and Written Opinion for International Application No. PCT/GB2018/051010, Search completed May 28, 2018, Mailed Jun. 6, 2018, 10 pgs.

Search Report under Section 17 for GB Application No. 1706116.9, Mailed on Oct. 31, 2017, 8 pgs.

(Continued)

*Primary Examiner* — Moriah S. Smoot

(74) *Attorney, Agent, or Firm* — Meunier Carlin & Curfman LLC

(57) ABSTRACT

A pellet comprising C-grade iron fines and a binder; a method of producing said pellet, comprising mixing the C-grade iron fines and the binder to form a mixture and agglomerating the mixture to form a pellet; and a method of producing steel, comprising heating a pellet comprising C-grade iron fines and a binder in an electric arc furnace.

19 Claims, No Drawings

(56) References Cited

FOREIGN PATENT DOCUMENTS

| | | | | | |
|---|---|---|---|---|---|
| JP | 2016222957 | A | | 12/2016 | |
| KR | 20130077158 | A | | 7/2013 | |
| RU | 2041961 | C1 | | 8/1995 | |
| SU | 1538902 | A3 | | 1/1990 | |
| WO | 9639290 | A1 | | 12/1996 | |
| WO | WO-1996039290 | A1 | * | 12/1996 | |
| WO | 1999024158 | A1 | | 5/1999 | |
| WO | 2001023627 | A1 | | 4/2001 | |
| WO | 2003012154 | A1 | | 2/2003 | |
| WO | 2007123512 | A1 | | 11/2007 | |
| WO | 2018033712 | A1 | | 2/2018 | |
| WO | WO-2018193243 | A1 | * | 10/2018 | ..... C22B 1/244 |
| WO | 2022200770 | A1 | | 9/2022 | |

OTHER PUBLICATIONS

"Direct Reduced Iron", Wikipedia (Year: 2017), 3 pgs.
Halt et al., "Cold Bonding of Iron Ore Concentrate Pellets", Mineral Processing and Extractive Metallurgy Review, vol. 36, No. 3, 2015, pp. 192-197, doi: 10.1080/08827508.2013.873863.

* cited by examiner

IRON CONTAINING PELLETS

CROSS REFERENCE TO RELATED APPLICATIONS

This application is a Continuation of U.S. patent application Ser. No. 18/551,584, entitled "Iron Containing Pellets" to Joyce et al., filed Sep. 20, 2023, which is a national stage of PCT Patent Application No. PCT/GB2022/050691, entitled "Pellet" to Joyce et al., filed Mar. 18, 2022, which claims priority to United Kingdom Patent Application No. 2103972.2, filed Mar. 22, 2021, the disclosures of which are incorporated by reference herein in their entirety.

FIELD OF THE INVENTION

The invention relates to pellets, in particular to iron containing pellets formed from C-grade fines.

BACKGROUND OF THE INVENTION

Whilst abundant in the Earth's core, as with all of Earth's resources, the amount of iron available is finite, and there are environmental costs associated with iron mining and smelting activities, particularly in terms of pollution. As a result, it is desirable to maximise the recycling of waste iron-containing materials, which in turn reduces the iron waste that must be handled, typically by long term storage in heaps or ponds.

SUMMARY OF THE INVENTION

Various embodiments are directed to a pellet including C-grade iron fines and a binder.

In still various embodiments the C-grade iron fines comprise in the range 50-95 wt % iron and/or ferroalloy.

In yet various embodiments the C-grade iron fines have a particle size distribution in the range 50 μm to 8 mm.

In still yet various embodiments the binder comprises an inorganic binder, an organic binder, or a combination thereof.

In yet still various embodiments the organic binder is present in the range 0.3-0.5 wt % of the pellet.

In still yet various embodiments the inorganic binder is present in the range 1 wt % to 6 wt %.

In yet still various embodiments the organic binder is of viscosity in the range 3,000-16,000 mPa-s.

In still yet various embodiments the binder comprises an inorganic binder comprising two or more silicates, wherein the two or more silicates comprise at least one in liquid form and at least one in powder form.

In yet still various embodiments the binder comprises a polymeric organic binder selected from polyacrylamide resin, resole resin, Novolac resin, polyvinyl alcohol and a polysaccharide.

In still yet various embodiments the binder comprises polyvinyl alcohol and wherein the polyvinyl alcohol is of molecular weight in the range of from 15,000 to 150,000.

In yet still various embodiments the binder comprises polyvinyl alcohol and further comprises a phenol-formaldehyde resin.

In still yet various embodiments pellets may further include a stabiliser.

In yet still various embodiments the stabiliser is selected from cellulosic material.

In still yet various embodiments pellets may include 0.05-0.5 wt % stabiliser.

In yet still various embodiments pellets may further include a cross-linking agent.

Many embodiments are directed to methods of producing a pellet including mixing the C-grade iron fines and binder to form a mixture and agglomerating the mixture to form a pellet.

In still many embodiments the pellet is cold-formed.

In yet many embodiments the agglomeration comprises at least one of the following: the formation of a binder matrix and compaction of the mixture.

In still yet many embodiments methods may include heating a pellet in an electric arc furnace.

In yet still many embodiments the pellet is heated under an oxidising atmosphere.

DETAILED DISCLOSURE

Technologies exist for the processing of waste iron, for instance from scrap metal, into steel. Often, the scrap metal is "shred" (from white goods or cars or other light gauge steel) or heavy melt (large slabs of beams) which is processed using electric arc furnaces. A problem with using scrap metal is that the quality of the steel input (and thus the steel produced) is often poor. As a result, steel produced from scrap metal often needs to be enhanced through the addition of relatively expensive sponge iron or pig iron. This can make the recycling of such wastes commercially non-viable.

WO 2018/193243 describes the production of steel from iron ore in electric arc furnaces, processing the iron ore in a reducing atmosphere to produce iron that can be converted to steel at a lower cost than the recycling of scrap metal using electric arc processing techniques.

C-grade iron fines are a product of the iron and steel smelting industry. For instance, C-grade iron fines are a grade of scrap metal, which remain after sorting of air-cooled slag. Produced in huge quantities they are regarded as a waste material, difficult to process and of low commercial value due to the difficulty in separating the components present (typically a mixture of iron ore, other metal ores, slag and iron). As a result, whilst other grades of smelting by-products are typically purified and recycled, C-grade iron fines are typically found as a component of the waste smelting material storage heaps described above.

This is partly because, C-grade iron fines generally comprise low levels of metallic iron, often in the range 20-40 wt % of the fines, and as such it has historically been economically impractical to extract the iron from the fines. Although, unlike metallic iron, it is possible for some ferroalloys to be extracted profitably at levels as low as 10 wt %. However, it would be desirable to recover this iron material, and the invention is intended to overcome or ameliorate at least some aspects of this problem.

Accordingly, in a first aspect of the invention there is provided a pellet comprising C-grade iron fines and a binder. These pellets can be used by the steel industry as a substitute for scrap metal, making good use of an otherwise wasted resource and helping to reduce the environmental pollution caused by the dumping of iron waste. The pellets have been found to offer a more consistent product than scrap metal, which has fewer impurities (in other words, the pellets are "cleaner" as scrap metal will usually contain, for example, oil, plastic, and/or copper as contaminants) and is less expensive as the C-grade iron fines have no commercial value and so the primary component of the pellet is essentially a no-cost component. Further, there are economic benefits to recycling the waste C-grade iron fines as opposed to discarding them, as the waste can be sold to generate revenue for the producer, decreasing the waste burden on the smelting company as the volume of waste produced would be significantly reduced.

As used herein the term "C-grade fines" is intended to be given its common meaning in the industry. The smelting of iron produces a range of metallic by-products, typically classed as A-grade, B-grade and C-grade. The categorisation is primarily by component size; the largest chunks forming A-grade scrap, smaller (generally less valuable) lumps forming B-grade scrap, and the fines forming C-grade scrap, or as they are generally termed, C-grade fines. As such, C-grade fines is a term for granular metallics comprising a low level of other materials. This is to be contrasted with "dust" which is oxidised metal particulates and "tailings" which are a washed particulate slurry containing impurities. Typically, C-grade fines are of mean particle diameter in the range of 50 μm to 10 mm, often in the range of 500 μm to 6 mm, often in the range of 1 mm to 4 mm. The particle size distribution is such that generally 100% of the c-fine particles will be of mean particle diameter less than 10 mm, often 80-100% of the particles will be of mean particle diameter less than 6.3 mm. This is unlike many metal powders or dusts which would be expected to have particle size distributions where the maximum particle size is around 1 mm.

Reference to "C-grade iron fines" is intended to cover any metallic iron and/or ferroalloy containing C-grade fine. The C-grade iron fines could be unprocessed, in which case they would typically comprise in the range 20-40 wt % of the fines metallic iron and/or ferroalloy, or they could be processed to increase the metallic iron and/or ferroalloy content to, for instance, in the range 50-95 wt % of the fines iron and/or ferroalloy, often 60-85 wt % or 70-80 wt %. The levels of iron found in processed C-grade iron fines are such that the pellets are an excellent, inexpensive and clean substitute for scrap metal sources of iron.

The terms "iron" and "metallic iron" are used interchangeably herein, and the term "ferroalloy" has its normal meaning in the art, specifically a ferroalloy is an alloy of iron (largest proportion but often less than 50% of the alloy) with a high proportion of one or more other elements. Well known ferroalloys include ferromanganese, ferrochromium, ferromolybdenum, ferrotitanium, ferrovanadium, ferrosilicon, ferroboron, and ferrophosphorus. As ferroalloys typically have lower melting point ranges than metallic iron, they are often used in the production of steel as they can be incorporated into the molten steel more easily than metallic iron.

It should be noted that the term "pellet" includes objects commonly referred to as pellets, rods, pencils and/or slugs. Pellets typically have a maximum mean diameter of 20 mm, more typically 16 mm or 15 mm, a minimum mean diameter of 2 mm, especially 5 mm or a mean diameter in the range 10-12 mm. These objects share the common feature of being a compacted form of material and are differentiated principally by their size and shape.

The C-grade iron fines are often agglomerated, the agglomeration step/formation of an agglomerate providing for fines which are easier to pelletise. Agglomeration being facilitated by the presence of the binder. Agglomerates are significantly easier to handle than the C-grade iron fines, allowing them to be easily transported and fed to the furnace. Moreover, the fine particulate and associated environmental hazard arising from working with the particulate has been removed. Prior to agglomeration, the C-grade iron fines generally have a mean particle diameter in the range of 50 μm to 10 mm, 500 μm to 6 mm, or 1 mm to 4 mm.

The binder may comprise an inorganic binder, an organic binder, or a combination thereof. Typically, the binder is present in the range 0.3 wt % to 6 wt %, often in the range 0.5 wt % to 4 wt %, often in the range 0.5 wt % to 2.5 wt %.

Often, the inorganic binder (either alone or in combination with one or more organic binders) is present in the range of from 1 wt % to 6 wt %, often 2 wt % to 4 wt %.

Often, the inorganic binder comprises one or more silicates (for example, a silicate in the form of its sodium salt), or refractory materials including, but not limited to, oxides, carbides, or nitrides of silicon, aluminium, magnesium, calcium, and zirconium. For example, the refractory material may comprise alumina, fireclays, bauxite, chromite, dolomite, magnesite, silicon carbide, zirconia, or combinations thereof. As used herein, the term "refractory material" refers to materials that are resistant to thermal stress, high pressure, or corrosion by chemical reagents. The one or more silicates may be in liquid form, powder form, or a combination thereof. When the one or more silicates is in liquid form, it will be present in greater amounts because there is a lower level of active in liquid silicates than in powder silicates. Where the one or more silicates is in liquid form, it is often present in the range of from 2 wt % to 6 wt %, often 3 wt % to 5 wt %. Where the one or more silicates is in powder form, it is often present in the range of from 0.5 wt % to 3.5 wt %, often 1 wt % to 3 wt %. It may be the case that there are two or more silicates present, at least one in liquid form and at least one in powder form. When two or more silicates are present, at last one in liquid form and at least one in powder form, it is often the case that the liquid and powder form are present in the ratio of from 5:1 to 1:1. Optionally, the ratio may be 3:1, optionally the ratio may be 3:2.

It may be the case that the inorganic binder further comprises one or more additives that interact with the binder to promote agglomeration of the c-grade fines. Examples of additives include, but are not limited to, glycerine acetates (such as diaceltylglycerols and triacetalglycerol), glycerol, glyoxal, or combinations thereof. Often, the additive is triacetalglycerol. Without being bound by theory, triacetalglycerol chemically interacts with the inorganic binder to aid in the agglomeration of c-grade fines.

Often, the organic binder is a polymeric organic binder, which may be selected from an organic resin, such as polyacrylamide resin, phenol-formaldehyde resin (such as resole resin or Novolac resin), and/or a polysaccharide (such as starch, hydroxyethyl methyl cellulose (MHEC), gum Arabic, guar gum or xanthan gum). The polysaccharide may be used as a thickening agent. Hydroxyethyl methyl cellulose (MHEC) has been found to have particularly good shelf life and enhance strength. This may be mixed with the organic resin.

Examples of starch include, for example, wheat, maize and barley starch. More typically the starch is potato starch as this is relatively inexpensive. Resoles are base catalysed phenol-formaldehyde resins with a formaldehyde to phenol ratio of greater than one (usually around 1.5). Novolacs are phenol-formaldehyde resins with a formaldehyde to phenol molar ratio of less than one.

When a phenol formaldehyde resin is present in combination with at least one inorganic and/or organic binder, it is often present in the range of from 0.1 wt % to 0.5 wt %, often 0.2 to 0.4 wt %.

The organic binder may be present in the range, 3000-16,000 mPa·s, often in the range 6000-14,000 mPa·s, or in the range 10,000-12,000 mPa·s, in some cases around 12,000 mPa·s. At these ranges it has been found that the binder offers optimum pellet strength.

It will often be the case that the polymeric organic binder comprises polyvinyl alcohol. Polyvinyl alcohol (PVA) may be used as a binder instead of or in addition to other binders, such that the polymeric organic binder may comprise 10-100 wt %, often 20-90 wt % or 50-75 wt % PVA. It may be the case that the binder comprises PVA and a phenol-formaldehyde resin. Alternatively, the polymeric organic binder may consist essentially of PVA or consist of PVA.

Without being bound by theory, the PVA is believed to provide for rapid curing, and high strength as the polymer network formed by PVA is strong. Further, the process of briquetting with PVA excludes air from the mass material, which may reduce oxidation of the metal. Metal oxidation is undesirable for the simple reason that it reduces the amount of the metallic iron available for processing by the end user.

Polyvinyl alcohol is typically commercially formed from polyvinyl acetate by replacing the acetic acid radical of an acetate with a hydroxyl radical by reacting the polyvinyl acetate with sodium hydroxide in a process called saponification. Partially saponified means that some of the acetate groups having been replaced by hydroxyl groups and thereby forming at least a partially saponified polyvinyl alcohol residue.

Typically, the PVA has a degree of saponification of at least 80%, typically at least 85%, at least 90%, at least 95%, at least 99% or 100% saponification. PVA may be obtained commercially from, for example, Kuraray Europe GmbH, Germany. Typically, it is utilised as a solution in water. The PVA may be modified to include, for example, a sodium hydroxide content.

Typically, the PVA binder has an active polymer content of 12-13% and a pH in the range of 4-7 when in solution. Further, the PVA will often be of molecular weight in the range of from 15,000-150,000. Optionally, the PVA will often be of molecular weight in the range of from 30,000 to 120,000. Without being bound by theory, it is believed that that, with lower molecular weights, for instance in the range 15,000-60,000, it is possible to prepare a binder solution of high concentration, which in turn can improve the strength of the pellets.

The organic binder (either alone, or in combination with one or more inorganic binders) may be present in the range 0.3-0.9 wt % of the pellet. Often, in the range 0.6-0.9 wt %. It has been found that where less than 0.3 wt % of the organic binder is present, the structural integrity of the agglomerate is low. Without being bound by theory this is believed to be because C-grade iron fines are of shape where packing is poor, and as a result, there are large voids between the particulates. Therefore, the organic binder does not operate to form a dispersed film on the surface of the particulates that will then simply stick adjacent particles together, as is often the mechanism of operation of organic binder materials. Instead, it is necessary for the organic binder to form a matrix from which incorporates the C-grade iron fines. As a result, more organic binder is required than would be typical. Further, this issue is exacerbated by the fact that in highly metallic regions of the C-grade iron fines, strong bonds are not formed with the organic binder. With less than 0.3 wt % organic binder the matrix can function to agglomerate the C-grade iron fines, but structural integrity is weak. In addition, it has been noted, that there are high levels of glassy elements present in the C-grade iron fines (as a result of the high slag content typically found). Further, for processed C-grade iron fines (for instance where there is a metallic iron and/or ferroalloy level of greater than 50 wt % of the fines), as the metal concentration rises, the metal begins to adopt a ball bearing shape, the physical properties of the surface of the ball bearings being smooth as opposed to ragged (as is the case with low metallic content C-grade iron fines, which may have, for instance, high levels of iron ore). This makes processed C-grade iron fines more difficult to agglomerate, and so more organic binder is required than would typically be the case.

Further, it has been found that where more than 1.0 wt % the organic binder is present, it can overwet and create sticky pellets, which is undesirable. This is partly because of the high density of the C-grade iron fines, and partly because they are not particularly absorbent.

As such, whilst it is possible to form agglomerates and pellets with higher and lower levels of organic binder, it is generally the case that the organic binder will be present in the range 0.3-0.9 wt % of the pellet, often in the range of 0.3 to 0.6 wt %.

Typically, clay binders are not added to the C-grade iron fines. Incorporation of such additional binders would reduce the purity of the briquettes reducing its commercial value.

The pellet will also typically comprise a stabiliser, wherein the stabiliser is optionally selected from cellulosic organic materials or plant-based gums. Typically, the stabiliser is selected from hydroxyethyl methyl cellulose, carboxymethyl cellulose (CMC), or guar gum. Typically, the stabiliser comprises hydroxyethyl methyl cellulose (MHEC) or carboxymethyl cellulose (CMC). Where present, the pellet will typically comprise 0.05-0.5 wt % stabiliser, often in the range of 0.1-0.4 wt %, often in the range of 0.25-0.35 wt %. The stabiliser can enhance mixing of the C-grade iron fines within the pellet. As the C-grade iron fines are dense (for instance they are denser than scrap metal), it can be useful to stabilise the systems while the binder matrix forms, ensuring that the C-grade iron fines remain well mixed within the binder.

The applicant has found that the strength and resilience of the briquette made using the first aspect of the invention, can be further improved by addition of a suitable cross-linking agent. Suitable cross-linking agents include, for example, glutaraldehydes, for example at 0.01 to 5 wt %. Sodium hydroxide, for example 0.1 wt %, may also be used as a cross-linking agent. Cross-linkers that are particularly suitable for use with PVA binders include glyoxal, glyoxal resin, PAAE resin (polyamidoamine epichlorohydrine), melamine formaldehydes, organic titanates (eg Tizor™, Du Pont), boric acid, ammonium, zirconium carbonate and glutaric dialdehyde-bis-sodium bisulphate. Typically, the cross-linking agent will be present in an amount of up to 5 wt % and more typically 3 wt % or 2 wt %.

Where the binder is PVA, this allows, for example, the amount of PVA to be reduced from, for example, 0.8 wt % or 0.5 wt % to, for example, 0.3 wt % or 0.4 wt % PVA. This is a cost-effective way of improving the strength of the material.

A waterproofing agent may be used to enhance the weather resistance of the material of the pellet. This may be combined with the C-grade iron fines or as a layer on the external surface of the pellet, for example by spraying. This includes, for example, styrene-acrylate copolymers, and bitumen emulsions.

However, it may be the case that the pellet consists of, or consists essentially of, C-grade iron fines and binder.

In a second aspect of the invention there is provided a method of producing a pellet according to the first aspect of the invention, the method comprising mixing the C-grade iron fines and binder to form a mixture and optionally agglomerating the mixture to form a pellet. As noted above, agglomeration is typically achieved through the formation of a binder matrix between the individual C-grade iron fine particles. Agglomeration can be further promoted by compaction of the mixture. This may be vacuum compaction, extrusion or pressing of the mixture. Compaction promotes the interaction of the binder with the C-grade iron fines. Typically pan mixers are used to agglomerate the mixture.

It may be the case that the pellet is cold-formed, for example without sintering, or heating to above 60° C. or above 40° C. or 30° C. prior to being processed to extract the metal (for instance by during steel processing). In other words, it will often be the case that the pellet will not intentionally be heated during formation, although frictional heat may be generated by any pressing and/or extrusion processes used to aid formation of the pellets and the binder may undergo exothermic reactions in situ. However, neither of these heat sources would be expected to generate enough heat to impact the formation of the pellet. The advantage to cold-forming is significant, in that because heating is not required there is no energy expenditure. There is also no need for furnaces to produce the pellets, resulting in a simpler and more economically and environmentally beneficial manufacturing process. Alternatively, it may be the case that low level heating, such as heating in the range of from 100° C. to 250° C. is applied. Low-level heating allows for faster forming of the pellet. When low level heating is applied, it is applied for a period of from 30 minutes up to 24 hours. The skilled person would understand and appreciate that factors such as the external ambient temperature, nature of the components in the formulation, and the desired properties of the pellets to be produced (e.g., a low water content) would impact the period of time that low level heating is applied. Therefore, the skilled person would consider such factors when determining the period of time and level of heat to apply in the process.

In a third aspect of the invention there is provided a method of producing steel comprising heating a pellet according to the first aspect of the invention in a furnace, such as an electric arc furnace. The use of an electric arc furnace, as opposed to a blast furnace, provides for a system which can exploit the flexibility of electric arc furnaces.

Typically, the pellet is heated under an oxidising atmosphere. Typically, oxygen is applied, which results in oxidation of carbon and contaminants from the iron present in the C-grade iron fines.

The invention also provides a method of producing steel comprising providing a pellet according to the invention, which is optionally produced by the method of producing the pellet according to the invention, transporting the pellet to an electric arc furnace and producing steel by a method of the invention.

The pellet may be produced at a separate site to where it is used. That is the pellet may be produced where there are deposits of, for example, iron ore fines, made into pellets by combining with the binder, and then transported to the electric arc furnace at a geographically separate site. Transportation may be, for example, by boat, road or rail.

Alternatively, a binder may be mixed with particulate iron ore on substantially the same site as the furnace, then placed into the furnace.

The pellets may be put into the furnace by, for example, a conveyor belt or other suitable means for moving the pellets.

There is therefore provided a pellet comprising C-grade iron fines optionally comprising in the range 50-95 wt % of the C-grade fines iron and/or ferroalloy and a binder comprising an inorganic binder, an organic binder, or a combination thereof. Optionally, the binder is 0.3 wt % to 6 wt % of the pellet. Optionally, the inorganic binder (either alone, or in combination with one or more organic binders) is 1 wt % to 6 wt % of the pellet. Optionally, the organic binder (either alone, or in combination with one or more inorganic binders) is 0.3-0.9 wt %, optionally 0.3-0.5 wt %, of the pellet. Optionally, the C-grade iron fines have a mean particle diameter in the range 20 μm-8 mm and the binder optionally comprises polyvinyl alcohol optionally of molecular weight in the range of from 15,000-150,000 and of viscosity in the range 3000-16,000 mPa·s. Optionally, the binder further comprises a phenol formaldehyde resin in combination with at least one inorganic and/or organic binder, often present in the range of from 0.1 wt % to 0.5 wt %, often 0.2 to 0.4 wt %. Optionally, the pellet further comprises 0.05-0.5 wt % stabiliser, wherein the stabiliser is optionally selected from cellulosic organic materials or plant-based gums. Typically, the stabiliser is selected from hydroxyethyl methyl cellulose, carboxymethyl cellulose, or guar gum. Typically, the stabiliser comprises hydroxyethyl methyl cellulose or carboxymethyl cellulose.

There is further provided a method of producing a cold-formed pellet as described, comprising mixing C-grade iron fines and binder to form a mixture, and agglomerating, optionally by the formation of a binder matrix, the mixture to form a pellet.

There is further provided a method of producing a pellet as described, comprising mixing C-grade iron fines and binder to form a mixture, and agglomerating, optionally by the formation of a binder matrix, and applying low-level heating, typically heating in the range of from 100° C. to 250° C., to the mixture to form a pellet. When low level heating is applied, it is applied for a period of 30 minutes up to 24 hours. As noted above, the skilled person would understand and appreciate that factors such as the external ambient temperature, nature of the components in the formulation, and the desired properties of the pellets to be produced (e.g., a low water content) would impact the period of time that low level heating is applied. Therefore, the skilled person would consider such factors when determining the period of time and level of heat to apply in the process.

In addition, there is provided a method of producing steel comprising heating a pellet as described in an electric arc furnace, optionally under an oxidising atmosphere. There is also provided a method of producing steel, comprising providing a pellet as described, optionally produced by the method described, transporting the pellet to an electric arc furnace and producing steel by the method described.

Unless otherwise stated, each of the integers described may be used in combination with any other integer as would be understood by the person skilled in the art. Further, although all aspects of the invention preferably "comprise" the features described in relation to that aspect, it is specifically envisaged that they may "consist" or "consist essentially" of those features outlined. In addition, all terms, unless specifically defined herein, are intended to be given their commonly understood meaning in the art.

Further, in the discussion of the invention, unless stated to the contrary, the disclosure of alternative values for the upper or lower limit of the permitted range of a parameter, is to be construed as an implied statement that each intermediate value of said parameter, lying between the smaller and greater of the alternatives, is itself also disclosed as a possible value for the parameter.

In addition, unless otherwise stated, all numerical values appearing in this application are to be understood as being modified by the term "about".

In order that the invention may be more readily understood, it will be described further with reference to the specific examples hereinafter.

EXAMPLES

Example 1—Assessment of Binder Functionality Related to Viscosity and Molecular Weight (i) The viscosity was measured at 50 RPM on a LAMY B-one Viscometer. All grades of PVA were purchased from Kuraray®.

TABLE 1

| | Viscosity (mPa · s) | MW (average weight) |
|---|---|---|
| Grade 1 PVA | 1500 | 40000 |
| Grade 2 PVA | 3260 | 50000 |
| Grade 3 PVA | 6100 | 50000 |
| Grade 4 PVA | 450 | 150000 |
| Grade 5 PVA | 10000 | 150000 |

Test specimens were produced using a highly metallised ferronickel substrate with a ferroalloy content of approximately 72% with standard addition rates and conditions. A stabilising binder was incorporated into the formulation. The metal content of the C-fines can be increased using multi-phase physical separation techniques such as crushing, grinding, air jigs, wet jigs, magnetic separation and wet high intensity magnetic separation, thus producing the highly metallised ferronickel and iron substrates of the examples.

(ii)

TABLE 2

| | Green Strength | Cured strength (N)* |
|---|---|---|
| Grade 1 PVA | unsatisfactory | No specimen could be produced |
| Grade 2 PVA | satisfactory | 3850 |
| Grade 3 PVA | good | 3300 |
| Grade 4 PVA | unsatisfactory | No Specimen could be produced |
| Grade 5 PVA | satisfactory | 1640 |

*A cured compressive strength of at least 1500N is desirable

It has been observed that a viscosity of greater than 3000 mPa·s and ideally at least 6000 mPa·s is desirable for both green strength (i.e. pellet formation) and cured strength.

It has been observed that a viscosity of 3000-6000 mPa·s will give a good cured strength, but green strength may be compromised at production scale, although other components could be added to modify the formulation.

It has been observed that a viscosity below 3000 mPa·s is unsatisfactory.

Example 2: Effect of Stabilisers on the Formulation

Iron C-fines were mixed with three binder formulations and briquettes of dimensions 20 mm×30 mm×40 mm were produced on a HUTT roller press at a pressure of 210 bar, and gravity feed.

TABLE 3

| | Cured Strength (N)* | Formulation |
|---|---|---|
| 1 | 1020 | PVA 0.6% with a cross-linking additive |
| 2 | 1490 | PVA 0.6% with a cross-linking additive and 0.2% cellulose fibres |
| 3 | 3440 | PVA 0.9% with a cross-linking additive and 0.2% cellulose fibres |
| 4 | 4590 | PVA 0.9% with a cross-linking additive and 1.0% of methyl hydroxyethyl cellulose |

*A cured compressive strength of at least 1500N is desirable

From a comparison of Formulations 1 and 2 it can be seen that the presence cellulose fibre stabilisers increased the cured strength of the pellets. A comparison of Formulations 2 and 3, and 3 and 4 shows that increasing the level of binder and stabiliser also improves the cured strength of the pellet. The briquettes had an iron content of around 85%.

Example 3: Further Working Examples

Ferronickel Fines were mixed with two binder formulations and briquettes were produced:

TABLE 4

| | Cured Strength (N)* | Formulation |
|---|---|---|
| 1 | 1620 | 0.44% of PVA of average molecular weight 150,000, with a crosslinking additive, and 0.1% cellulose fibres |
| 2 | 2110 | 0.9% of PVA of average molecular weight 40,000, with a crosslinking additive, and 0.1% cellulose fibres |
| 3 | 2330 | 0.6% of PVA of average molecular weight 40,000, with a crosslinking additive, and 0.1% cellulose fibres. |
| 4 | 1660 | 0.5% of anionic polyacrylamide with a cross-linking additive and 0.1% cellulose fibres |

*A cured compressive strength of at least 1500N is desirable

Example 4: Vibro-Compacted Specimens

Samples of iron C-fines and ferro-nickel were produced by the method of vibro-tamping:

The two samples were generated by mixing the respective materials in a direct action pan mixer the placed into a 150 mm×150 mm concrete testing moulds. No release agent was used. The moulds were filled in one layer and compacted using an electric reciprocating hammer drill for 10 seconds. A 148 mm square plate was used to apply the force evenly.

The specimens were able to be freely released from the mould in the green condition The green samples provided strengths as shown below when tested on a concrete load testing machine illustrating that this is a useful pelletisation method:

Ferronickel: 14.5 $N/mm^2$

Iron: 6.1 $N/mm^2$

Example 5—Particle Size Distribution of C-Fines a Range or Iron Containing Compounds

TABLE 5

| Product | Steel Shot | C-Fines 150420 | Millscale | C-Fines 170920 | Oxide | Fe Jig (AK Steel) | Shot Dust (AK Steel) | Alloy Powder | Iron Powder |
|---|---|---|---|---|---|---|---|---|---|
| 10 mm | 100 | 100 | 98.46 | 100 | 100 | 97.12 | 100 | 100 | 100 |
| 6.3 mm | 100 | 81.68 | 97.09 | 99.3 | 99.53 | 79.23 | 100 | 100 | 100 |
| 4 mm | 99.44 | 48.14 | 95.7 | 77.21 | 84.85 | 43.38 | 100 | 100 | 99.67 |
| 2 mm | 99.09 | 15.24 | 92.83 | 11.96 | 33.51 | 13.67 | 100 | 100 | 98.81 |
| 1 mm | 98.13 | 3.35 | 86.48 | 0.98 | 4.29 | 4.1 | 100 | 100 | 98.31 |
| 500 μm | 94.39 | 1.42 | 73.19 | 0.7 | 0.94 | 2.69 | 100 | 99.86 | 97.86 |
| 250 μm | 86.75 | 0.94 | 52.45 | 0.58 | 0.71 | 2.23 | 99.94 | 57.11 | 55.54 |
| 125 μm | 52.63 | 0.75 | 23.7 | 0.52 | 0.71 | 1.86 | 98.83 | 24.56 | 3.66 |
| 63 μm | 14.16 | 0.62 | 7.21 | 0.52 | 0.71 | 1.38 | 96.1 | 13.24 | 1.89 |
| Moisture | 1.21 | 2.88 | 2.73 | 1.56 | 3.54 | 3.76 | 0.45 | 0.14 | 0.66 |

The particle size distribution was measured using BS EN 933-1:2012.

Example 6—Inorganic Binder System

Iron C-fines were mixed with four inorganic binder formulations and briquettes were produced on a HUTT roller press at a pressure of 210 bar, and gravity feed. 10

TABLE 6

| Material | Sodium silicate liquid grade | Sodium Silicate Powder grade | Green Strength | Average Cured Compressive Strength (kN) |
|---|---|---|---|---|
| Iron C-fines | 4% | 1.5% | Visual high yield and handleable | 4.46 |
| Iron C-fines | 4% | 1% | Visual high yield and handleable | 6.03 |
| Iron C-fines | 5% | 2% | Visual high yield and handleable | 5.57 |

The table illustrates that where a combination of liquid and powdered silicate is present, good compressive strengths and handleability can be obtained.

As iron c-grade fines are often in the form of a rounded particle (high sphericity) and have a narrow particle size distribution, it can be difficult to achieve a strong agglomerate, as there is a low level of mechanical interlock within the fines matrix. However, as is evident from Table 6, the inorganic binder systems above result in pellets with both a high green strength and a high cured compressive strength.

It would be appreciated that the products and processes of the invention are capable of being implemented in a variety of ways, only a few of which have been illustrated and described above.

What is claimed is:

1. A pellet comprising, a plurality of C-grade iron fines; and a binder;

wherein the plurality of C-grade iron fines comprises a plurality of particles of scrap metal;

wherein the plurality of particles have a particle size distribution, the particle size distribution having a particle size range from 50 μm to 10 mm, which remain after the sorting of air cooled slag;

wherein the scrap metal comprises at least one of a metallic iron and a ferroalloy, the scrap metal selected from the group consisting of:

a plurality of unprocessed iron fines, each of the plurality of unprocessed iron fines having a wt % range of 20 to 40 of at least one of metallic iron and ferroalloy, and a plurality of processed iron fines having a wt % range of 50 to 95 of at least one of metallic iron and ferroalloy;

wherein the binder is selected from the group consisting of at least one inorganic binder, at least one organic binder, or a combination thereof.

2. The pellet of claim 1, wherein the at least one organic binder is a polymeric organic binder selected from the group consisting of polyacrylamide resin, resole resin, novolac resin, polyvinyl alcohol, and a polysaccharide.

3. The pellet of claim 1, wherein the plurality of C-grade iron fines comprises the plurality of processed iron fines, each of the plurality of processed iron fines having a wt % range of greater than 40 to 95 of at least one of metallic iron, ferroalloy, and a combination thereof.

4. The pellet of claim 1, wherein the plurality of C-grade iron fines comprises the plurality of processed iron fines, each of the plurality of processed iron fines having a wt % range from 50 to 95 of at least one of metallic iron, ferroalloy, and a combination thereof.

5. The pellet of claim 1, wherein, the particle size range is from 50 μm to 8 mm.

6. The pellet of claim 1, further comprising at least one of steel shot and mill scale.

7. The pellet of claim 1, wherein the organic binder has a wt % of 0.3 to 0.5 of the pellet.

8. The pellet of claim 1, wherein the inorganic binder has a wt % of 1 to 6 of the pellet.

9. A pellet according to claim 1, wherein the binder comprises polyvinyl alcohol.

10. A pellet according to claim 9, wherein the polyvinyl alcohol has a degree of saponification of at least 85%.

11. The pellet of claim 1, wherein the organic binder has a viscosity of 3,000 to 16,000 mPa-s.

12. The pellet of claim 1, wherein the binder comprises the inorganic binder and the inorganic binder comprises at least one of silicates, and a refractory material selected from the group consisting of oxides, carbides, and nitrides of silicon, aluminium, magnesium, calcium, and zirconium.

13. The pellet of claim 2, wherein the polymeric organic binder is polyvinyl alcohol with a degree of saponification of at least 85%.

14. The pellet of claim 2, wherein the binder comprises polyvinyl alcohol and phenol-formaldehyde resin.

15. The pellet of claim 1, further comprising a stabiliser.

16. The pellet of claim 15, wherein the stabiliser is a cellulosic material.

17. The pellet of claim 15, wherein the stabiliser has a wt % of 0.05 to 0.5 of the pellet.

18. The pellet of claim 1, further comprising a cross-linking agent.

19. A pellet comprising, a plurality of C-grade iron fines; and a binder;

wherein the plurality of C-grade iron fines comprises a plurality of particles of scrap metal;

wherein the plurality of particles have a particle size distribution, the particle size distribution having a particle size range from 50 μm to 10 mm, which remain after the sorting of air cooled slag;

wherein of scrap metal comprises at least one of a metallic iron and a ferroalloy, of scrap metal selected from the group consisting of:

a plurality of unprocessed iron fines, each of the plurality of unprocessed iron fines having a wt % range of 20 to 40 of at least one of metallic iron and ferroalloy, and a plurality of processed iron fines having a wt % range of 50 to 95 of at least one of metallic iron and ferroalloy;

wherein the binder is selected from the group consisting of at least one organic binder, or a combination of the at least one organic binder and at least one inorganic binder; wherein the at least one organic binder comprises a polymeric organic binder selected from the group consisting of polyacrylamide resin, resole resin, novolac resin, polyvinyl alcohol, and a polysaccharide.

* * * * *